US007128214B2

(12) United States Patent
Qiu et al.

(10) Patent No.: US 7,128,214 B2
(45) Date of Patent: Oct. 31, 2006

(54) REINFORCED PACKAGING SUPPORT POST ASSEMBLY

(75) Inventors: Yanping Qiu, Middleton, WI (US); Lawrence E. Renck, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/683,356

(22) Filed: Dec. 18, 2001

(65) Prior Publication Data

US 2003/0111383 A1 Jun. 19, 2003

(51) Int. Cl.
*B65D 81/03* (2006.01)
*B65D 81/113* (2006.01)

(52) U.S. Cl. ..... 206/586

(58) Field of Classification Search ..... 52/732.1, 52/731.2, 730.4, 736.3, 737.4, 118, 731.4; 206/586, 591, 594, 320, 453, 814
See application file for complete search history.

(56) References Cited

U.S. PATENT DOCUMENTS

| | | | | |
|---|---|---|---|---|
| 304,790 | A * | 9/1884 | Butz | 52/731.4 |
| 1,446,239 | A * | 2/1923 | Yumura | 362/431 |
| 3,244,347 | A | 4/1966 | Jenk | |
| 3,337,111 | A | 8/1967 | Patriekis et al. | |
| 3,536,245 | A | 10/1970 | Palmer | |
| 3,648,920 | A | 3/1972 | Stump | |
| 3,854,579 | A | 12/1974 | Scharre | |
| 3,935,357 | A | 1/1976 | Padovani | |
| 4,482,054 | A | 11/1984 | Gardner | |
| 4,483,444 | A | 11/1984 | Gardner | |
| 4,771,893 | A | 9/1988 | Liebel | |
| 4,795,666 | A * | 1/1989 | Okada et al. | 428/71 |
| 5,175,041 | A | 12/1992 | Webb et al. | |
| 5,267,651 | A | 12/1993 | Hughes | |
| 5,275,677 | A | 1/1994 | Morley | |
| 5,450,703 | A * | 9/1995 | Fuhrman et al. | 52/730.4 |
| 5,471,809 | A * | 12/1995 | Frankel | 52/737.4 |
| 5,593,039 | A * | 1/1997 | Ortlieb | 206/586 |
| 6,059,104 | A * | 5/2000 | Widman | 206/320 |
| 6,186,329 | B1 * | 2/2001 | Qiu | 206/586 |
| 6,234,314 | B1 * | 5/2001 | Qiu et al. | 206/586 |
| 6,247,596 | B1 * | 6/2001 | Muyskens | 206/586 |
| 6,286,683 | B1 * | 9/2001 | Hunt et al. | 206/586 |
| 6,467,756 | B1 * | 10/2002 | Elsasser | 256/65.14 |
| 6,513,662 | B1 * | 2/2003 | Stebelton | 206/586 |
| 6,520,336 | B1 * | 2/2003 | Baechle | 206/586 |

FOREIGN PATENT DOCUMENTS

| | | |
|---|---|---|
| JP | 7276543 | 10/1995 |
| JP | 11059733 | 3/1999 |

* cited by examiner

*Primary Examiner*—Mickey Yu
*Assistant Examiner*—Jerrold Johnson
(74) *Attorney, Agent, or Firm*—Clausen Miller, P.C.

(57) ABSTRACT

A reinforced corner post assembly for cushioning and protecting a packaged article from axial and lateral forces. The assembly comprises a conventional corner post having an outer wall and an inner wall joined at opposing ends to form a hollow tube and one or more reinforcing tubes disposed longitudinally within the hollow interior of the corner post.

3 Claims, 3 Drawing Sheets

REINFORCED PACKAGING SUPPORT POST ASSEMBLY

BACKGROUND OF INVENTION

This patent relates to packaging for large products such as furniture and household appliances. More particularly, this patent relates to a tubular-type package support post reinforced with separate tubular structures to provide increased resistance to axial and lateral compression forces.

Warehousing and distribution environments drive the need for devices that protect products (such as furniture and appliances) from both axial (vertical) and lateral (horizontal) forces. Axial forces mainly are caused by stacking packaged products in warehouses. Lateral forces can be caused by stacking, clamp handling and basiloid handling, and also by collisions inherent in warehouse and distribution systems.

Corner posts consisting essentially of formed hollow paperboard tubes are often used to support and cushion large boxed or packaged articles during warehousing and shipping. Conventional corner posts are made of paperboard covered on one side with adhesive, wound onto a mandrel having a substantially circular cross-section, and then—before the adhesive sets—formed on a forming tool into a desired shape, typically one having a modified "L" shaped cross section. The dried finished corner posts are inserted into the corners of a package between the package and the article.

The use of corner posts placed vertically inside a package between the package and the product increases resistance to axial forces and allows packaged products to be stacked. However, as warehouse-stacking heights have increased, the likelihood that the corner posts will buckle under the increased axial compression forces, thereby allowing the package to crush, has also increased. Thus there is a need for a corner post having greater resistance to axial compression forces.

The use of corner posts also increases resistance to lateral (side) impact forces and forces caused by clamp handling and basiloid handling. It is not uncommon to use a clamp truck to move packaged appliances in a block three units high, three units across and two units deep. Such clamp handling can impart lateral forces on the packaged products of up to 2,500 PSI. Existing corner posts do not always provide sufficient protection against such large lateral forces. Thus there is a need for a corner post having greater resistance to lateral compression forces.

Various means have been considered for increasing the resistance of wound paperboard corner posts to axial and lateral forces, including increasing the thickness of each paperboard ply, increasing the number of plies, and increasing the ply strength. However, these proposed solutions can increase costs, slow down production, and make it more difficult to form posts into the desired shapes. Also, these solutions do not always result in a corner post having the desired resistance to axial compression or lateral forces due to the innate tendency of corner posts to buckle because of the high ratio of length to cross-section diameter and the relatively large span of long, flat vertical areas in the structure.

Thus it is an object of the present invention to provide a corner post having increased resistance to axial compression and lateral forces.

Another object of the present invention is to provide corner posts having different performance characteristics but the same outer post design.

Yet another object is to provide a compression resistant corner post that is less costly and easier to make than corner posts having more or thicker plies.

Further objects will appear from the description, accompanying drawings, and appended claims.

SUMMARY OF INVENTION

The present invention is a reinforced corner post assembly for cushioning and protecting a packaged article from axial and lateral forces. In one embodiment the assembly comprises a conventional corner post having an outer wall and an inner wall joined at opposing ends to form a hollow tube and one or more reinforcing tubes disposed longitudinally within the hollow interior of the corner post.

The corner post is manufactured from a single sheet of material that is wetted with adhesive, wound into a tube, formed and dried. The reinforcing tubes may be inserted into the hollow interior of the corner post during or after manufacture of the corner post.

Preferably, the reinforcing tubes are spiral paperboard tubes having circular cross sections having a diameter that enables the tubes to fit snugly within the hollow interior of the corner post. Typically, the length of the tubes and the corner post is the same. The tubes are held in place by forces applied by the interior surfaces of the outer and inner walls and/or may be affixed to the outer and inner walls by adhesive or other means. Beads formed in the walls of the corner post may also help hold the reinforcing tubes in place. The reinforcing tubes may be marked according to their physical characteristics and selected "off the shelf" at the point of use.

In another embodiment, the reinforcing tubes are disposed within longitudinal grooves integrally formed in the walls of the corner post. Each groove has opposing sides extending from the wall along opposing edges. The distance between the edges is less that the outer diameter of the reinforcing tubes in order to secure the tubes within the grooves.

In still another embodiment, the reinforcing tubes are held within longitudinal slots integrally formed in the walls of the corner post during manufacture.

DETAILED DESCRIPTION

Figure 1:
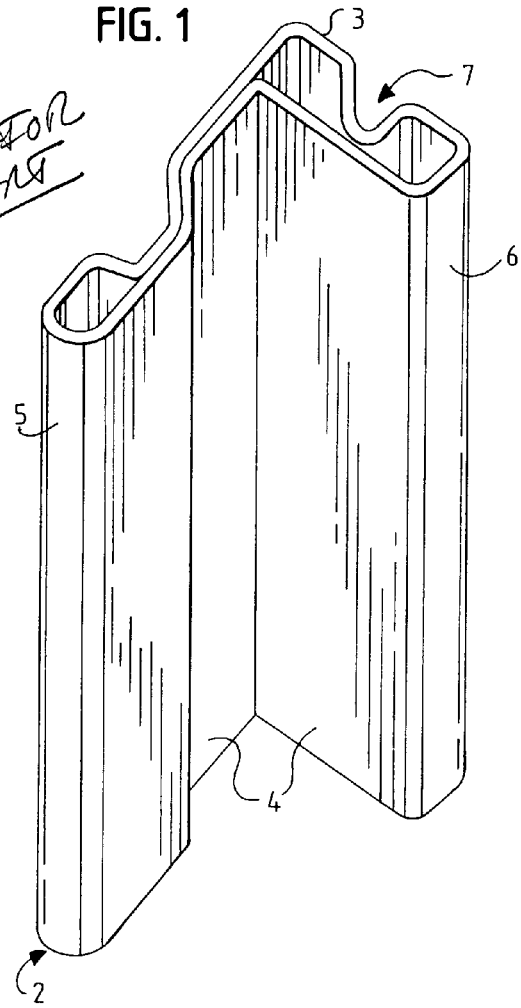
FIG. 1 PRIOR ART
FIG. 1 is a perspective view of a conventional corner post.

Turning to the drawings, there is shown in FIG. 1 a perspective view of a conventional corner post. The corner post 2 is made from a single sheet of paper or paperboard convolutely wound several times into a hollow tube having a circular cross-section and then reshaped into the modified L-shape shown in the figure. This L-shape enables the corner post to fit snugly around the corners of a product between the product and the package containing the product. The "L" shape also enhances structural strength both axially (vertically) and laterally (horizontally). Adhesive is used to bond consecutive layers of paper during winding. The reshaping of the tube into the desired final shape occurs before the adhesive begins to set.

The corner post 2 generally comprises an outer wall 3 (i.e., the wall adjacent the package when the corner post is installed) and an inner wall 4 (i.e., the wall adjacent the packaged article). The outer and inner walls meet at rounded distal ends 5 and 6 to define the hollow tube. The outer wall typically includes integrally formed beads or grooves 7 for added stiffness and resistance. The corner post 2 normally extends upward from a base pad located beneath the product to a top cap or lid, and is wedged between the product and the package to provide lateral cushioning of the product and axial support of the product packaging.

Figure 2:
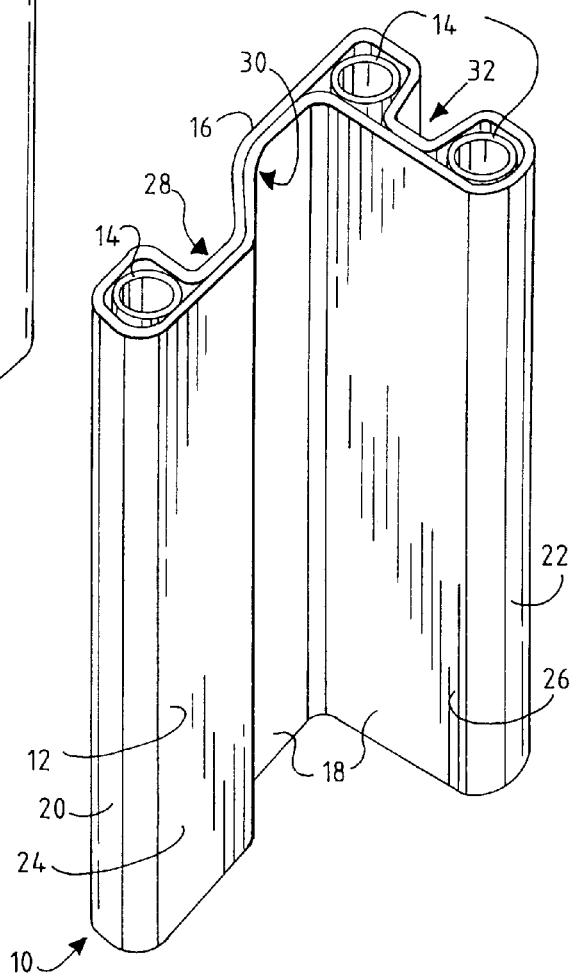
FIG. 2 is a perspective view of a reinforced support post assembly according to the present invention.

FIG. 2 is a perspective view of a preferred embodiment 10 of a reinforced corner post assembly made according to the present invention. The corner post assembly 10 comprises a longitudinal corner post 12 and reinforcing tubes 14. The reinforcing tubes 14 are located inside the hollow interior of the corner post 12 and held there by friction or other means, as will be described below. Preferably, the reinforcing tubes 14 extend the full longitudinal (vertical) length of the corner post 12, although, where axial compression strength is not important, the tubes 14 may be shorter than the corner post 12 to provide sidewall reinforcement. It is not necessary that the tubes occupy the entire hollow interior of the corner post.

The corner post 12 of FIG. 2 is conventional in design and manufacture. Typically, the corner post 12 is made from a single sheet of convolutely wound paper or paperboard formed into a rigid structure having a substantially L-shaped cross-section. The corner post 12 comprises an outer wall 16 and an inner wall 18 that meet at rounded ends 20, 22 to define a hollow interior space. When installed, the corner post 12 is wedged between the product and the package with the outer wall 16 facing two perpendicular sides of the package and the inner wall 18 facing the product inside the package. The "L" shape is formed by the two orthogonal legs 24 and 26. In the illustrated embodiment, leg 24 is longer than leg 26 (in the horizontal plane) but equal in width to leg 26, although the legs may be any suitable length or width.

The longer leg 24 has a bead 28 formed in its outer wall 16 and a second bead 30 formed in its inner wall 18. The beads 28, 30 are slightly offset from each other but are adjacent. The shorter leg 26 has a bead 32 formed in its outer wall 16 that extends inward toward the inner wall 18. The beads (28, 30 and 32) help hold the reinforcing tubes 14 in place.

The reinforcing tubes 14 preferably are relatively small diameter spiral paperboard tubes having a circular cross-section, although other cross-sectional shapes are within the scope of the invention, such as triangular, square or rectangular. In this first embodiment, the reinforcing tubes 14 are inserted into the hollow interior spaces of both legs 24, 26 of the L-shaped corner post 12. One spiral tube 14 is disposed within the longer leg 24 and two spiral tubes 14 are disposed within the shorter leg 26. The reinforcing tubes 14 are collinear with the longitudinal corner post 12. That is, the axis of the tubes 14 is parallel to the longitudinal axis of the corner post 12, thus providing improved resistance to axial (vertical) compression forces.

The reinforcing tubes 14 may be inserted into the hollow interior spaces during or after manufacture of the corner post 12. For example, during manufacture of the corner post 12, the tubes 14 may be inserted while the corner post 12 is still wet from the adhesive. Upon drying, the corner post 12 may shrink slightly in the horizontal plane ("tighten up"), causing the reinforcing tubes 14 to be captured and held tightly in place within the corner post 12 by frictional and/or lateral forces applied by the interior surfaces of the inner and outer walls 16, 18. The reinforcing tubes may also be adhered to the interior surfaces of the inner and outer walls 16, 18 by adhesive, two-sided tape, staples, clips, or any other suitable means of attachment.

Figure 4:
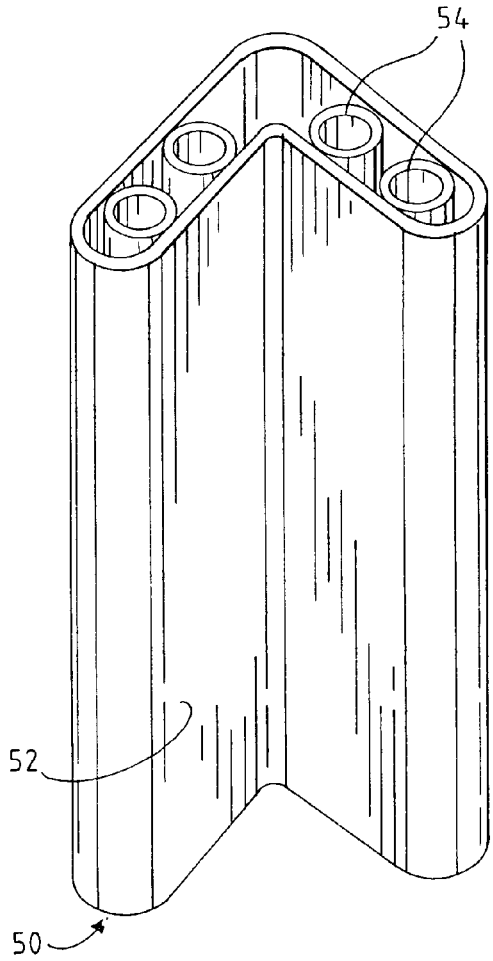
FIG. 4 is a perspective view of a third embodiment of a reinforced support post assembly according to the present invention.

Although the embodiment shown in FIG. 2 comprises three reinforcing tubes 14, any number of tubes 14 may be used, depending on the configuration of the corner post and the desired physical characteristics. FIG. 4, for example, shows a reinforced corner post assembly having four reinforcing tubes disposed inside the corner post.

The corner post assembly of the present invention need not be configured exactly as shown in FIG. 2. For example, the distance between the inner and outer walls of the corner post can be vary from that shown in FIG. 2, and can even vary between one leg and another for the same post. The corner post walls may or may not have integrally formed beads. The dimensions of the reinforcing tubes can be changed to fit the interior dimensions of the corner post. Preferably, the outside diameter of the reinforcing tubes is that which causes the tubes to be held in place within the corner post by the corner post walls. The wall thickness of the reinforcing tubes can be varied to achieve different performance characteristics, such as strength and stiffness.

The reinforcing tubes can be spiral wound (preferred) or convolutely wound. Although wound paper and paperboard is preferred, the reinforcing tubes can be made of any suitable material, including molded plastic.

For ease of use, the reinforcing tubes can be labeled, color coded, or otherwise marked to indicate cost and/or performance characteristics. The tubes can then be selected "off the shelf" based on the desired cost and performance characteristics.

Figure 3:
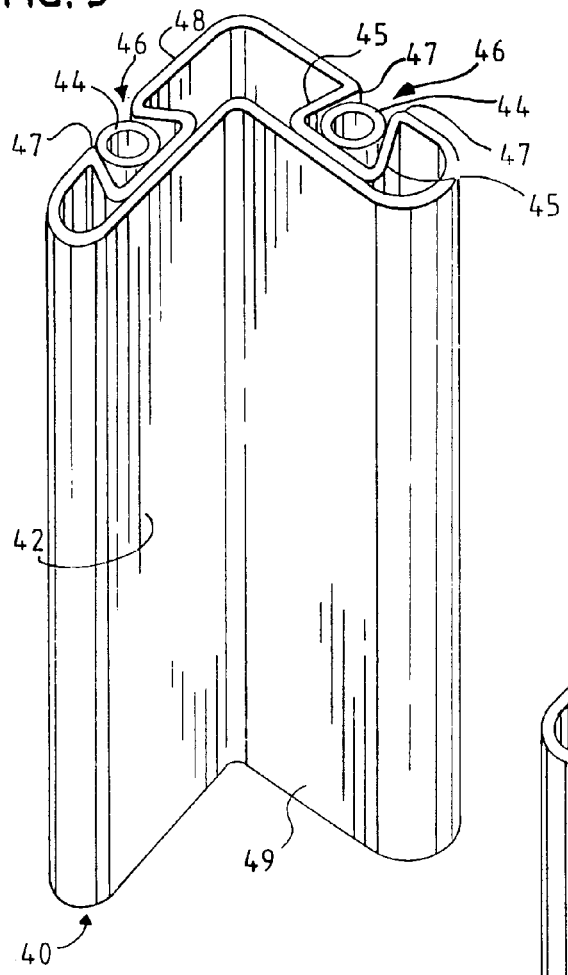
FIG. 3 is a perspective view of a second embodiment of a reinforced support post assembly according to the present invention.

FIG. 3 shows a second embodiment of a reinforced corner post assembly, the assembly 40 again comprising a corner post 42 and reinforcing tubes 44. In this embodiment, the reinforcing tubes 44 are inserted into grooves 46 integrally formed in the corner post outer wall 48, although the grooves 46 could also be formed in the inner wall 49. The grooves 46 include opposing sides 45 extending from the outer wall 48 along edges 47, with one or both sides 45 forming an acute angle with the outer wall 48.

The distance from one edge 47 to the opposite edge 47 should be less than the outer diameter of the reinforcing tube 46 in order to hold the reinforcing tube 44 within the groove. Where the groove 46 is substantially circular in cross-section, the groove 46 defines an arc of more than 180 degrees. The reinforcing tube 44 may be inserted telescopically into one end of the groove or snapped into place by forcing the tube 44 through the gap between opposing edges 47.

FIG. 4 is a perspective view of a third embodiment of the reinforced corner post assembly of the present invention. This third embodiment 50 comprises a corner post 52 and reinforcing tubes 54. Unlike the preferred embodiment in FIG. 2, the corner post 52 does not have strengthening beads to help hold the reinforcing tubes 54 in place inside the corner post 52. Instead, the reinforcing tubes 54 are held in place by the flat interior surfaces of the corner post walls. To help maintain the position of the reinforcing tubes inside the corner post, the reinforcing tubes may be adhered to the corner post walls by glue or other means. The reinforcing tubes 54 may also be connected to each other with webbing, such as laminate or paper (not shown).

Figure 5:
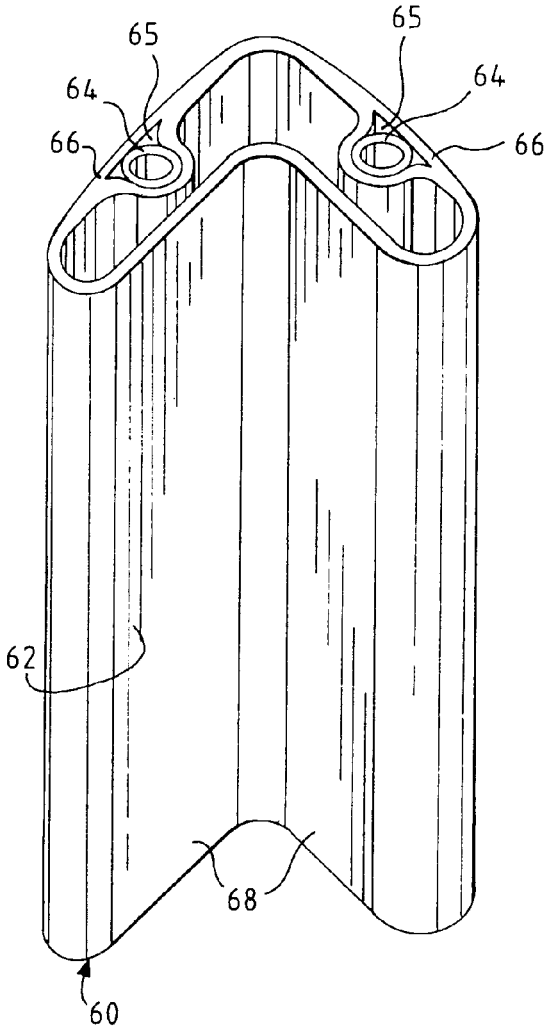
FIG. 5 is a perspective view of a fourth embodiment of a reinforced support post assembly according to the present invention.

FIG. 5 is a perspective view of a fourth embodiment of the reinforced corner post assembly of the present invention. This fourth embodiment 60 also comprises a corner post 62 and reinforcing tubes 64. The reinforcing tubes 64 are disposed within longitudinal slots 65 formed in the corner post outer wall 66 and defined by opposing plies. Preferably the reinforcing tubes 64 are inserted into the slots 65 during manufacture of the corner post 62.

The slotted corner post 62 is formed by wrapping paper or paperboard around a mandrel having integral grooves where the slots 65 are to be located. After the wrapping step, the paperboard is scored along the grooves and the layers of paperboard are pushed into the grooves. The reinforcing tubes 64 are then inserted into the grooves and are captured by one or more additional layers of paperboard. Upon drying, the slots 65 tighten around the tubes 64 to hold them in place.

Although FIG. 5 depicts a corner post assembly 60 having two reinforcing tubes 64, both located in the outer wall 66 and none in the inner wall 68, any number of tubes 64 may be incorporated into the outer and/or inner walls of the corner post 62.

Figure 6:
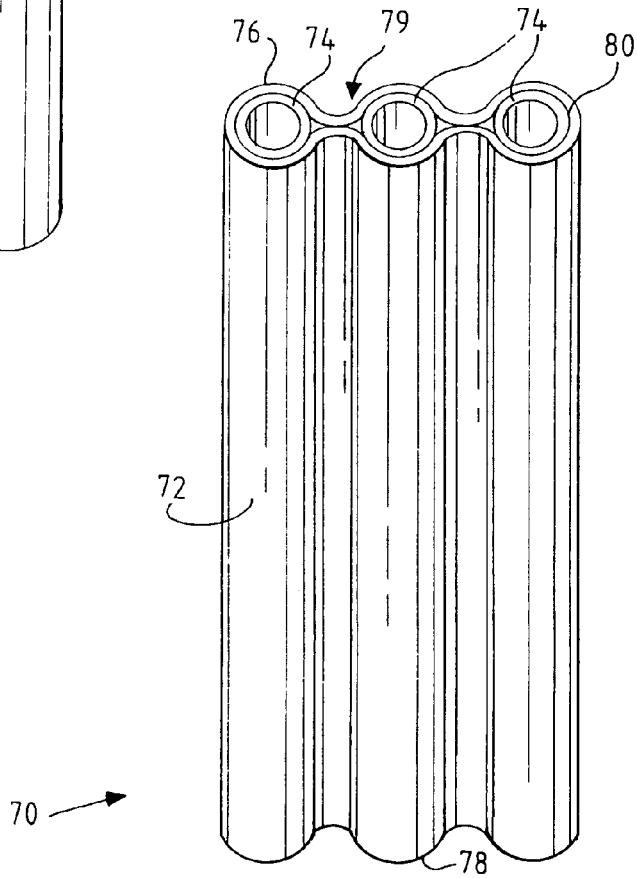
FIG. 6 is a perspective view of a fifth embodiment of a reinforced support post assembly according to the present invention.

FIG. 6 is a perspective view of a fifth embodiment of the present invention, showing how the invention may be used to cushion and protect the flat sides of a packaged article. The reinforced support assembly 70 of FIG. 6 comprises a structural support 72 and reinforcing tubes 74. The structural support 72 has a substantially "I" shaped cross-section and is intended to be placed between a flat side of a packaged article and a wall of the package. The structural support 72 comprises an outer wall 76 and an inner wall 78 joined at opposite ends. The walls may or may not have beads 79 formed integrally therein. In the illustrated embodiment, the outer and inner walls have two sets of integrally formed opposing beads 79. The opposing beads 79 may contact each other, as they do in FIG. 6, to define multiple hollow spaces 80 for receiving the reinforcing tubes 74. Preferably, the outside diameter of the reinforcing tubes 74 is such that the tubes 74 fit snugly within the hollow spaces 80 of the structural support 72.

EXAMPLE

Sidewall (lateral) compression tests were performed on convolutely wound paperboard L-shaped corner posts having one leg shorter than the other (similar to the corner post shown in FIG. 2) with and without spirally wound paperboard reinforcing tubes inserted into the shorter leg. Sidewall displacement (bending) was plotted as a function of sidewall compression force. At 500 lbs. lateral compression force, the average sidewall displacement was about 1.2 inches without the reinforcing tubes, but less than 1.0 inch with the reinforcing tubes.

Additional sidewall compression tests were performed on L-shaped corner posts with and without a reinforcing tube inserted into the longer leg. At 500 lbs. lateral compression force, the average sidewall displacement was about 1.35 inches without the reinforcing tubes, but only about 1.0 inch with the reinforcing tubes. The test results indicate that the addition of reinforcing tubes to an L-shaped corner post significantly increases the resistance of the corner post to lateral compression forces.

Other modifications and alternative embodiments of the invention are contemplated which do not depart from the scope of the invention as defined by the foregoing teachings and appended claims. It is intended that the claims cover all such modifications that fall within their scope.

The invention claimed is:

1. A reinforced corner post assembly comprising:

a longitudinal corner post having an outer wall and an inner wall joined at opposing ends to form a tube having a hollow interior, a longitudinal groove being integrally formed in one of the walls, the groove including opposing sides extending from the wall along opposing edges; and a reinforcing tube disposed within the longitudinal groove, the reinforcing tube having an outer diameter greater than the distance from one edge to the opposite edge.

2. The assembly of claim 1 wherein the outer wall has an exterior side facing away from the hollow interior, and the groove is integrally formed in the exterior side of the outer wall.

3. A reinforced corner post assembly comprising:

a longitudinal corner post formed from a single sheet of material wound into a hollow tube having two or more layers, the corner post having an outer wall and an inner wall joined at opposing ends and a longitudinal slot integrally formed in one of the walls between opposing layers; and a reinforcing tube disposed within the longitudinal slot.

* * * * *